United States Patent [19]

Kobayashi et al.

[11] Patent Number: 5,055,006

[45] Date of Patent: Oct. 8, 1991

[54] SUBMERGED MOTOR PUMP HAVING AN OUTER CASING WHICH IS RADIALLY DEFORMABLE

[75] Inventors: Makoto Kobayashi, Kawasaki; Kiyoshi Ouchi, Fujisawa; Shinji Nishimori, Yokohama; Tsuyoshi Maeda, Fujisawa; Yoshio Miyake, Yokohama, all of Japan

[73] Assignee: Ebara Corporation, Tokyo, Japan

[21] Appl. No.: 306,901

[22] Filed: Feb. 7, 1989

[30] Foreign Application Priority Data

Feb. 8, 1988 [JP] Japan ..... 63-25599
Nov. 15, 1988 [JP] Japan ..... 63-286923

[51] Int. Cl.[5] ..... F04B 39/06

[52] U.S. Cl. ..... 417/366; 417/423.3; 417/423.14

[58] Field of Search ..... 417/366, 423.3, 423.14, 417/424.1

[56] References Cited

U.S. PATENT DOCUMENTS

| | | | |
|---|---|---|---|
| 3,153,382 | 10/1964 | Barcom Jr. | 417/423.3 |
| 3,775,024 | 11/1973 | Ulm | 417/423.3 |
| 4,523,899 | 6/1985 | Ouchi | 417/423.3 |
| 4,778,354 | 10/1988 | Idei | 417/366 |
| 4,806,083 | 2/1989 | LaGrange et al. | 417/423.14 |

FOREIGN PATENT DOCUMENTS

| | | |
|---|---|---|
| 0163126 | 4/1985 | European Pat. Off. . |
| 56-107981 | 8/1981 | Japan . |
| 60-32586 | 3/1985 | Japan . |
| 60-32587 | 3/1985 | Japan . |

OTHER PUBLICATIONS

Patent Abstracts of Japan, vol. 6, No. 89 (M-132)[967], 27th May 1982; & JP-A-57-26 295 (Hitachi Seisakusho K.K.) 12-02-82.

*Primary Examiner*—Leonard E. Smith
*Assistant Examiner*—Eugene L. Szczecina, Jr.
*Attorney, Agent, or Firm*—Oblon, Spivak, McClelland, Maier & Neustadt

[57] ABSTRACT

Disclosed is a submerged motor pump of the type in which a motor is installed inside an outer casing so as to define an annular passage therebetween and a pumped liquid is discharged to the outside through the annular passage while cooling the entire periphery of the motor. The outer casing is formed using a resilient material and is retained at its upper and lower ends by rigid members. Accordingly, the outer casing is deformable in the radial direction so as to absorb external force, for example, impact force, which may be applied thereto during transportation.

6 Claims, 7 Drawing Sheets

SUBMERGED MOTOR PUMP HAVING AN OUTER CASING WHICH IS RADIALLY DEFORMABLE

BACKGROUND OF THE INVENTION

1. Field of the Invention

The present invention relates to a submerged motor pump of the type in which a motor is installed inside an outer casing such as to define an annular passage therebetween and a pumped liquid is discharged to the outside through the annular passage while cooling the entire periphery of the motor, the motor pump being suitably used as a portable pump for draining water from a pit.

2. Description of the Prior Art

FIG. 1 shows a typical conventional submerged motor pump of the type described above. A motor 1 and a pump casing 3 which incorporates an impeller 2 are connected together as one unit to define a motor pump body. The motor pump body is surrounded by an outer casing 4. The upper end of the outer casing 4 is formed integral with a cover plate 4*a* having a discharge port 5. A bottom plate which also serves as a strainer 6 is secured to the lower end of the outer casing 4. In the figure, the reference numeral 7 denotes a motor head cover, while the numeral 8 denotes a protective resilient ring which serves as a cushioning member.

In pumping operation, a liquid which is sucked in through the strainer 6 is pressurized by means of the impeller 2 inside the pump casing 3, discharged into the space defined between the outer casing 4 and the motor pump body and then discharged to the outside while cooling an outer casing of the motor 1 through the discharge port 5.

Referring next to FIG. 2, which is a sectional view of another prior art, an outer casing 4 which is formed from a thin metal plate is mounted in such a manner as to be clamped between a motor head cover 7 made of a rigid material and a pump casing 3 which is formed from a resilient material reinforced by a metal core 3*a*. The upper and lower end portions of the outer casing 4 are engaged with the motor head cover 7 and the pump casing 3 through resilent seal members (boots) 101, respectively, thereby preventing leakage of pumped liquid through the joints.

In this prior art, the upper side of the resilient pump casing 3 is covered with an intermediate casing 9 which is made of a rigid material and these two casings 3 and 9 are fastened together by means of a plurality of bolts 102 (only one is shown). The intermediate casing 9 is fastened to the underside of the motor 1 by means of a plurality of bolts 103 (only one is shown). The head 103*a* of the bolt 103 is received in a recess 9*a* which is provided on the underside of the intermediate casing 9. In the figure, the reference numeral 2 denotes an impeller, 3*b* a fluid passage also serving as a strainer which is formed in the bottom portion of the pump casing 3, 3*c* a pump casing discharge port, and 5 a pump discharge port.

The above-described conventional submerged motor pumps (those shown respectively in FIGS. 1 and 2) suffer, however, from the following problems.

In the prior art, the pump casing 3 and the outer casing 4 are produced as discrete members and the outer casing 4 is formed using a thin metal plate, e.g., a thin iron plate, with a view to reducing the weight of the machine.

However, the outer casing 4 must have a sufficient thickness to prevent deformation due to external forces, for example, any impact applied thereto during transportation. In actuality, however, the tickness of the outer casing 4 is reduced because priority is given to the desire for a reduction in weight. Accordingly, the outer casing 4 is readily deformed when subjected to external forces.

Since the pump casing 3 and the outer casing 4 are formed as separate members from a metal, the structure of the motor pump is complicated and the bulk densities of materials used to form the motor pump are relatively high, which results in an overall increase in weight.

In the prior art (shown in FIG. 2) wherein the upper end portion of the outer casing 4 made of a thin metal plate and the lower end portion of the motor head cover 7 are engaged with each other through the grooved seal member (boot) 101 made of a resilient material, sealing effect is achieved by pressing the resilient seal member 101 predominantly in the axial direction.

However, if such a grooved seal member (boot) 101 is applied to a pump which has an outer casing 104 made of a resilient material, as shown in FIG. 3(*a*), when internal pressure P is applied to the outer casing 104, it may be deformed both radially and axially, as shown in FIGS. 3(*b*) to 3(*d*), and the sealing performance will thus deteriorate or become nullified. In the case where the resilient outer casing 104 is engaged directly with the lower end portion of the motor head cover 7 without using the above-described resilient seal member, as shown in FIG. 4(*a*), and, when internal pressure P is applied to the casing 104, a gap is produced at the area of contact between the two members, as shown in FIG. 4(*b*), resulting in a deterioration of the sealing performance.

In the prior art (shown in FIG. 2) wherein the upper side of the pump casing 3 made of a resilient material reinforced by the metal core 3*a* is covered by the intermediate casing 9 made of a rigid material, the pump casing 3 and the intermediate casing 9 are fastened together by means of the bolt 102. In the case where a pump bottom plate 105 is secured to the bottom of the resilient pump casing 3, as shown in FIG. 5(*a*), the resilient pump casing 3 is clamped at the upper and lower sides thereof by the rigid intermediate casing 9 and the pump plate 105, respectively, and these members are fastened together by means of a through-bolt 102 which is passed therethrough from the lower side thereof through a spacer 106 which defines the interference of the resilient pump casing 3.

In this case, however, the number of parts required to fasten the above-described members together increases, and it is difficult to align the intermediate casing 9, the pump casing 3 and the pump plate 105 with each other.

In the case where a stud bolt 102*b* which has been previously threaded into the intermediate casing 9 is passed through the resilient pump casing 3 and the pump plate 105 with the spacer 106 interposed therebetween and then these members are fastened together by means of a nut 102*d* which is screwed onto the bolt 102*b* from the lower side, as shown in FIG. 5(*b*), alignment of the intermediate casing 9, the pump casing 3 and the pump plate 105 is facilitated, but the number of parts required is even larger than in the case of the arrangement shown in FIG. 5(*a*).

In the case where a special double-end stud bolt 102*c* which defines the interference of the resilient pump casing 3 is threaded into the intermediate casing 9 in advance and passed through the pump casing 3 and the pump plate 105 and these members are fastened together by means of a nut 102*d* which is screwed onto the bolt 102*c* from the lower side, as shown in FIG. 5(*c*), the number of parts required is relatively small and the alignment is facilitated. However, this arrangement necessitates employment of the special bolt 102*c* which is not commercially available.

In the prior art (shown in FIG. 2) wherein the upper side of the resilient pump casing 3 is covered with the rigid intermediate casing 9, the head 103*a* of the bolt 103 that is used to fasten the intermediate casing 9 to the underside of the motor 1 is received in the recess 9*a* provided on the underside of the intermediate casing 9. Accordingly, the intermediate casing 9 must be sufficiently thick to ensure the required strength which results in an increase in weight and it also makes it difficult to turn and drive the bolt 103 in the recess 9*a*.

SUMMARY OF THE INVENTION

In view of the above-described circumstances, it is an object of the present invention to provide a submerged motor pump which is so designed that any external force applied thereto is absorbed by deformation of a resilient member.

It is another object of the present invention to provide a submerged motor pump which is so designed as to have a simple structure which enables the reduction of the overall weight of the pump.

It is still another object of the present invention to provide a submerged motor pump which is so designed that it is possible to maintain the required sealing performance at the joint of the end portion of a resilient outer casing and a rigid member even if the outer casing is deformed due to internal or external pressure.

It is a further object of the present invention to provide a submerged motor pump having a fastening means which enables three members, that is, a pump casing portion which is formed intergral with a resilient outer casing from the same material, an intermediate casing and a pump plate, to be readily aligned with each other and fastened together with a reduced number of parts.

It is a still further object of the present invention to provide a submerged motor pump which is so designed that it is possible to reduce the thickness of an intermediate casing which is fastened to the underside of a motor by means of a bolt and in which a bolt driving operation is facilitated.

To these ends, the present invention provides a submerged motor pump wherein a motor is installed inside an outer casing so as to define an annular passage therebetween and a pumped liquid is discharged to the outside through the annular passage while cooling the entire periphery of the motor, the submerged motor pump being characterized in that: the outer casing is formed of a resilient material such as a rubber material and that the resilient outer casing is retained at its axial upper and lower ends by rigid members, respectively.

According to another of its aspects, the present invention provides a submerged motor pump wherein a pump casing and an outer casing are formed integral with each other using a resilient material such as a rubber material, the integral structure being retained at its axial upper and lower ends by rigid members, for example, a motor head cover and a pump bottom plate, thereby enabling the outer casing to be deformable in the radial direction.

According to another of its aspects, the present invention provides a submerged motor pump wherein the upper end portion of the resilient outer casing is provided with either an annular projection or an annular groove, while the lower end portion of a rigid member which retains the upper end portion of the outer casing is provided with the other of the two, that is, the annular projection and the annular groove.

According to another of its aspects, the present invention provides a submerged motor pump wherein the upper side of a pump casing which is formed integral with a resilient outer casing using the same material, such as rubber, is covered with an intermediate casing formed of a rigid material, the intermediate casing having a leg portion provided integral with the underside thereof, the leg portion being downwardly tapered and extending through the pump casing, so that the pump casing is clamped between the intermediate casing and a pump bottom plate by means of a bolt which is brought into threaded engagement with a threaded portion formed in the leg portion.

According to another of its aspects, the present invention provides a submerged motor pump wherein the upper side of a pump casing which is formed integral with a resilient outer casing using the same material is covered with an intermediate casing formed of a rigid material, the intermediate casing being fastened to the underside of a motor by means of a bolt the head of which is received in a recess formed in the resilient outer casing which is in contact with the underside of the intermediate casing.

By virtue of the above-described arrangement, when the submerged motor pump of the present invention is run on a floor surface of the like, a liquid is sucked into the inside of the pump casing through a gap defined between a rigid member, for example, a bottom plate, and the pump casing which is located above the rigid member. The sucked liquid is pressurized by means of an impeller, discharged from a discharge port provided in the pump casing to an annular space defined between a motor and the outer casing so as to flow along the entire circumference of the motor while cooling the outer casing thereof, and is then discharged to a predetermined place from a discharge port provided in a rigid member, for example, a motor head cover, through a discharge conduit connected to the discharge port. This pumping operation is the same as that employed in the prior arts (shown in FIGS. 1 and 2).

In the present invention, however, since the outer casing is formed using a resilient material and is retained at both its upper and lower ends by the rigid members the outer casing is deformable radially so as to absorb any external force, for example, impact force, which may be applied thereto during transportation.

Further, if the pump casing and the outer casing are formed integral with each other using a resilient material and this integral structure is retained at its upper and lower ends by the rigid members, the number of parts is reduced and hence the structure is considerably simplified, so that assembly and disassembly are facilitated.

If a strainer is formed integral with the underside of the pump casing, a liquid is sucked into the pump casing through the strainer during a pumping operation, thereby enabling removal of foreign matter from the pumped liquid.

When the upper end portion of the resilient outer casing is provided with either an annular projection or an annular groove, while the lower end portion of the rigid member which retains the upper end portion of the outer casing is provided with the other of the two, the fitting engagement between the annular projection and groove provided at the upper end of the outer casing and the lower end of the rigid member is maintained and the required sealing performance is ensured even when the resilient outer casing is deformed by internal or external pressure.

When downwardly tapered leg portions are provided integral with the underside of the rigid intermediate casing, it is possible to reduce the number of parts required to fasten the pump casing which is formed integral with the resilient outer casing between the intermediate casing and the pump bottom plate by means of bolts which are brought into threaded engagement with the threaded portion formed in the leg portion, and it is also possible to facilitate alignment during assembly.

In addition, when the head of each bolt used to fasten the rigid intermediate casing to the underside of the motor is received in a recess formed in that portion of the resilient outer casing or pump casing which is in contact with the underside of the intermediate casing, it is unnecessary to employ an excessively thick intermediate casing in order to ensure the required strength, and it is therefore possible to reduce the thickness and weight of the intermediate casing. Further, the operation of turning and driving the bolts can readily be conducted outside the intermediate casing.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements and, of which.

DETAILED DESCRIPTION OF THE DRAWINGS

Embodiments of the present invention will be described hereinunder in detail with reference to the accompanying drawings.

Figure 6:
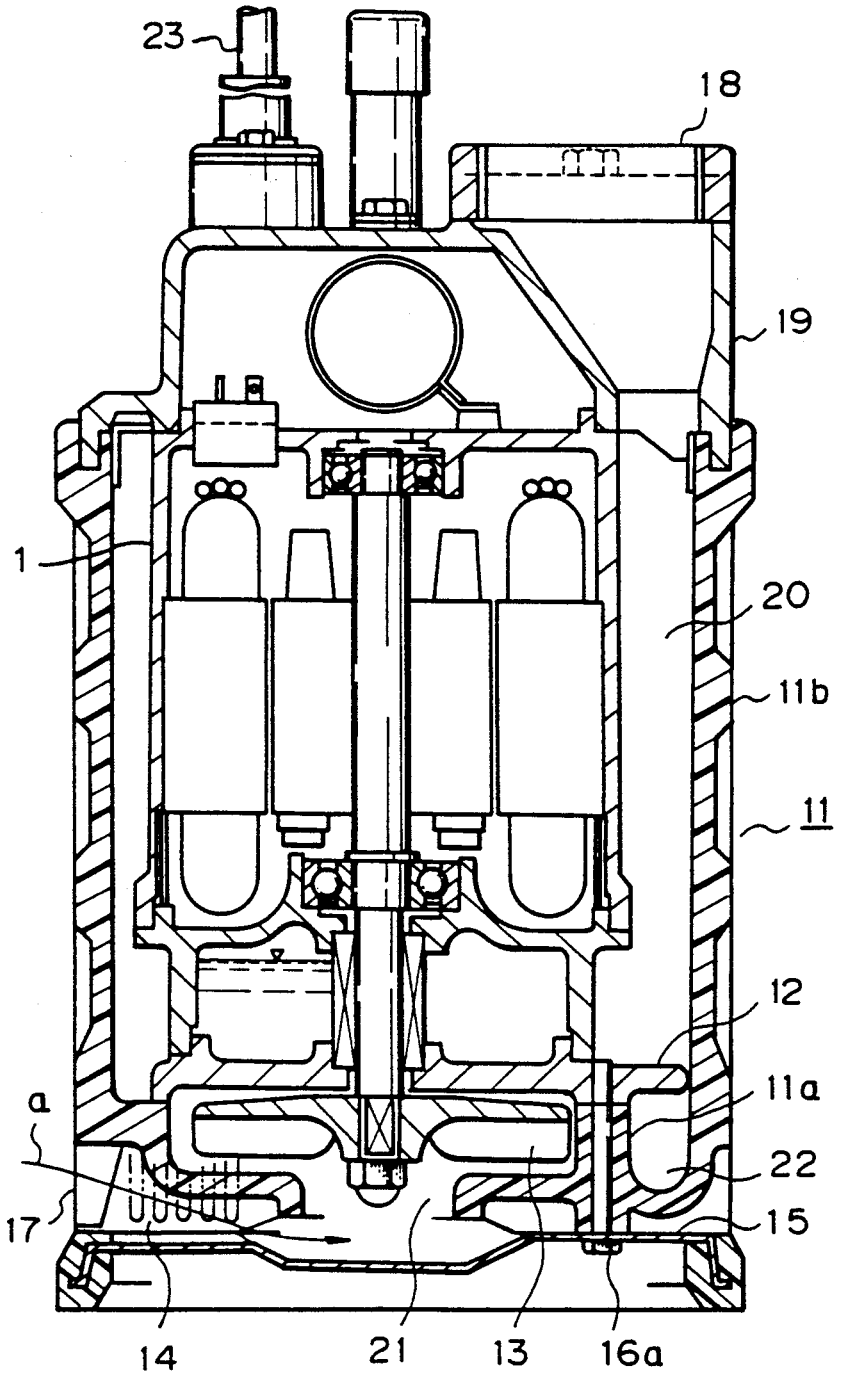
FIGS. 6 and 7 are vertical sectional views respectively showing first and second embodiments of the submerged motor pump according to the present invention.

FIG. 6 is a vertical sectional view of a first embodiment of the submerged motor pump according to the present invention.

Referring to FIG. 6, a pump casing portion 11*a* and an outer casing portion 11*b* are formed as two portions of an integral structure defined by a resilient member 11 made, for example, of a rubber material. The upper side of the pump casing portion 11*a* is covered with an intermediate casing 12 made of a rigid material, and an impeller 13 is incorporated inside the pump casing portion 11*a*. A bottom plate 15 which is made of a rigid material is attached to the underside of the resilient pump casing portion 11*a* such that a fluid passage 14 through which a liquid is sucked is defined therebetween and the intermediate casing 12, the pump casing portion 11*a* and the bottom plate (pump plate) 15 are fastened together by means of a plurality of through-bolts 16*a* (only one is shown) in such a manner that the pump casing portion 11*a* is clamped by the other two members. A plurality of projections 17 serving in combination as a strainer are integrally provided on the underside of the pump casing portion 11*a* such that the projections 17 are spaced apart from each other along the entrance of the fluid passage 14 extending around the entire periphery of the motor pump.

The upper end portion of the resilient outer casing portion 11*b* which is formed integral with the pump casing portion 11*a* is retained by bolts or the like to a motor head cover 19 which is, in turn, fastened by bolts or the like to a pump discharge port 18. In the figure, the reference numeral 20 denotes an annular passage which is defined between the outer casing portion 11*b* and the outer surface of the motor 1, 21 a pump casing suction port, 22 a pump casing discharge port, and 23 a cable joint.

Incidentally, in this embodiment, the intermediate casing 12 is fastened to the underside of the pump 1 by a suitable fastening means such as a plurality of bolts.

The operation of the above-described embodiment will next be explained.

In a pumping operation, a fluid flows into the inside of the pump casing portion 11*a*, that is, the pump chamber, through the pump casing suction port 21 from the passage 14 which is defined between the underside of the pump casing portion 11*a* and the bottom plate 15, as shown by the arrow a. At this time, any foreign matter contained in the fluid is removed by means of the projections 17 which serve in combination as a strainer.

The fluid flowing into the pump casing portion 11*a* is pressurized by the operation of the impeller 13, discharged from the casing discharge port 22 to flow through the annular passage 20 defined between the outer periphery of the motor 1 and the outer casing portion 11*b* while cooling the outer casing of the motor and is then discharged to the outside from the pump discharge port 18.

Since the pump casing portion 11*a* and the outer casing portion 11*b* are formed integral with each other using a resilient material and this integral resilient structure is retained at both its upper and lower ends by the rigid members, respectively, the outer casing portion 11*b* is deformable radially and it is therefore possible to effectively absorb any external force which may be applied thereto during transportation of the motor pump. Namely, a motor pump of this type often has to be thrown or handled roughly during transportation of the same and is, therefore, subjected to various external forces. However, the outer casing portion 11*b* is able to effectively absorb such external forces. As a result, it becomes possible to use a thin-walled light material, e.g., a plastic material, to form internal structural parts, because any external force is effectively absorbed by the outer casing portion and is not directly transmitted to the internal structural parts. This enables a reduction in the overall weight in combination with the fact that the bulk density of the resilient material is lower than that of a metallic material.

Figure 1:
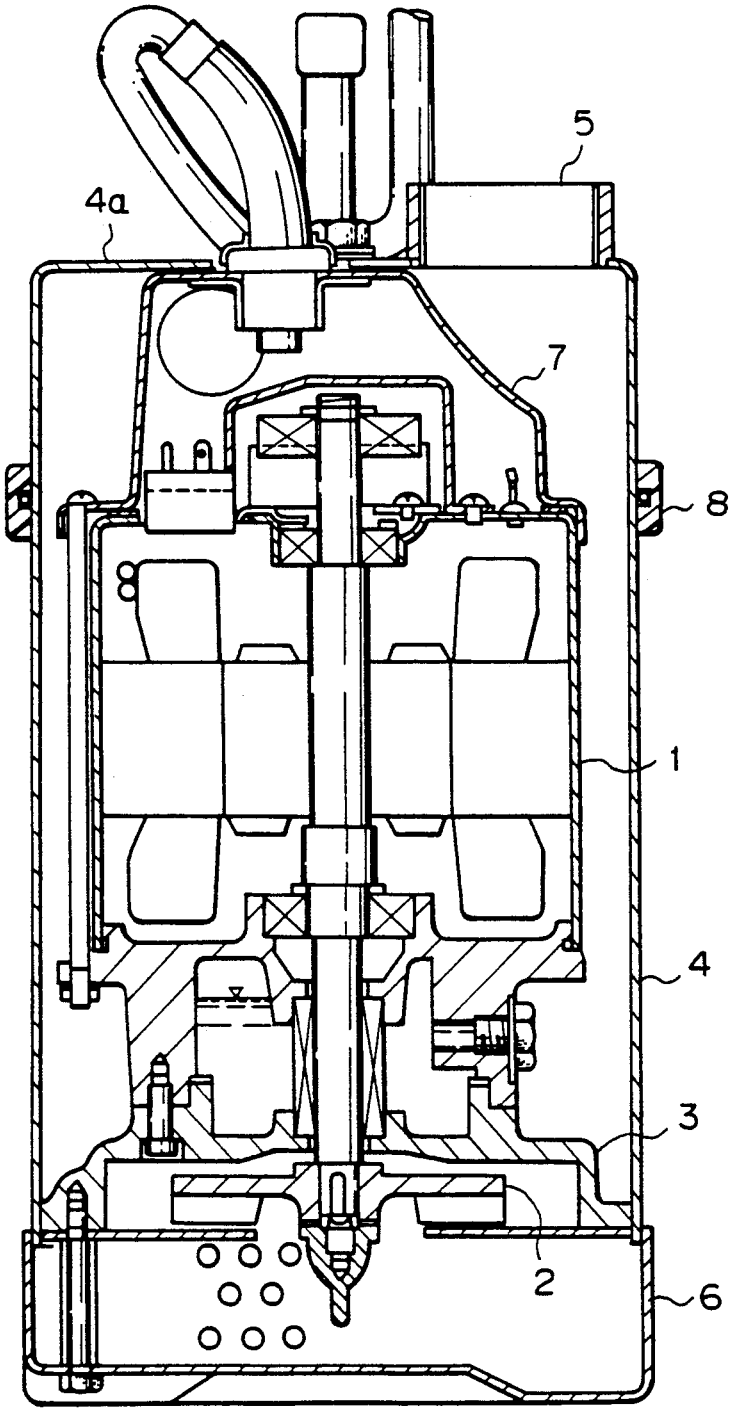
Fig. 1 PRIOR ART
FIGS. 1 and 2 are vertical sectional views respectively showing two different types of conventional submerged motor pumps.
Figure 7:
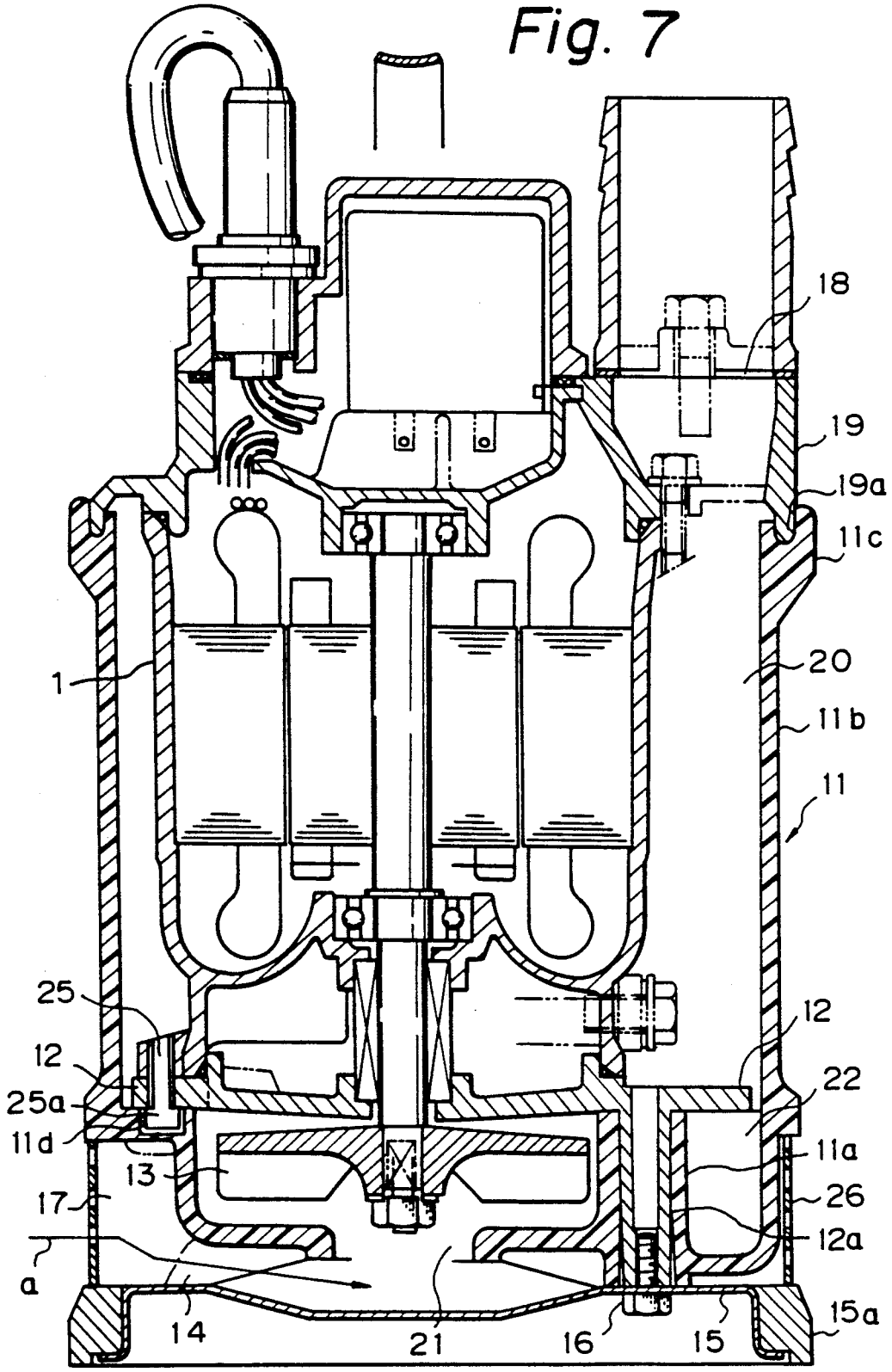

FIG. 7 is a vertical sectional view of a second embodiment of the submerged motor pump according to the present invention, in which the same reference numerals as those in FIG. 1 denote the same or like elements.

This embodiment is the same as the first embodiment in that the pump casing portion 11*a* and the outer casing portion 11*b* are formed as two portions of an integral structure defined by a resilient member 11 made, for example, of a rubber material, and the pump casing portion 11*a* is covered on its upper side by an intermediate casing 12 and has an impeller 13 incorporated therein.

In this embodiment, however, a bottom plate (pump plate) 15 which is made of a rigid material is attached to the underside of the resilient pump casing portion 11*a* so as to define therebetween a fluid passage 14 through which a liquid is sucked, and a plurality of downwardly tapered leg portions 12*a* (only one is shown) is provided integral with the underside of the intermediate casing 12, the leg portions 12*a* extending through the pump casing portion 11*a*. Thus, the intermediate casing 12, the pump casing portion 11*a* and the bottom plate 15 are fastened together such that the pump casing portion 11*a* is clamped between the other two members by means of bolts 16 which are brought into threaded engagement with internally threaded bores formed in the leg portions 12*a*.

An annular groove is formed in the upper end portion 11*c* of the resilient outer casing portion 11*b*. Thus, the outer casing portion 11*b* is engaged with the motor head cover 19 in such a manner that an annular projection provided at the lower end 19*a* of the motor head cover 19 is fitted into the annular groove.

The intermediate casing 12 which is to be fastened to the pump casing portion 11*a* in the manner described above is fastened to the underside of the motor 1 by means of a plurality of bolts 25 (only one is shown). The head 25*a* of each bolt 25 is received in a recess 11*d* which is formed in the resilient outer casing portion 11*b* which is in contact with the intermediate casing 12.

Figure 2:
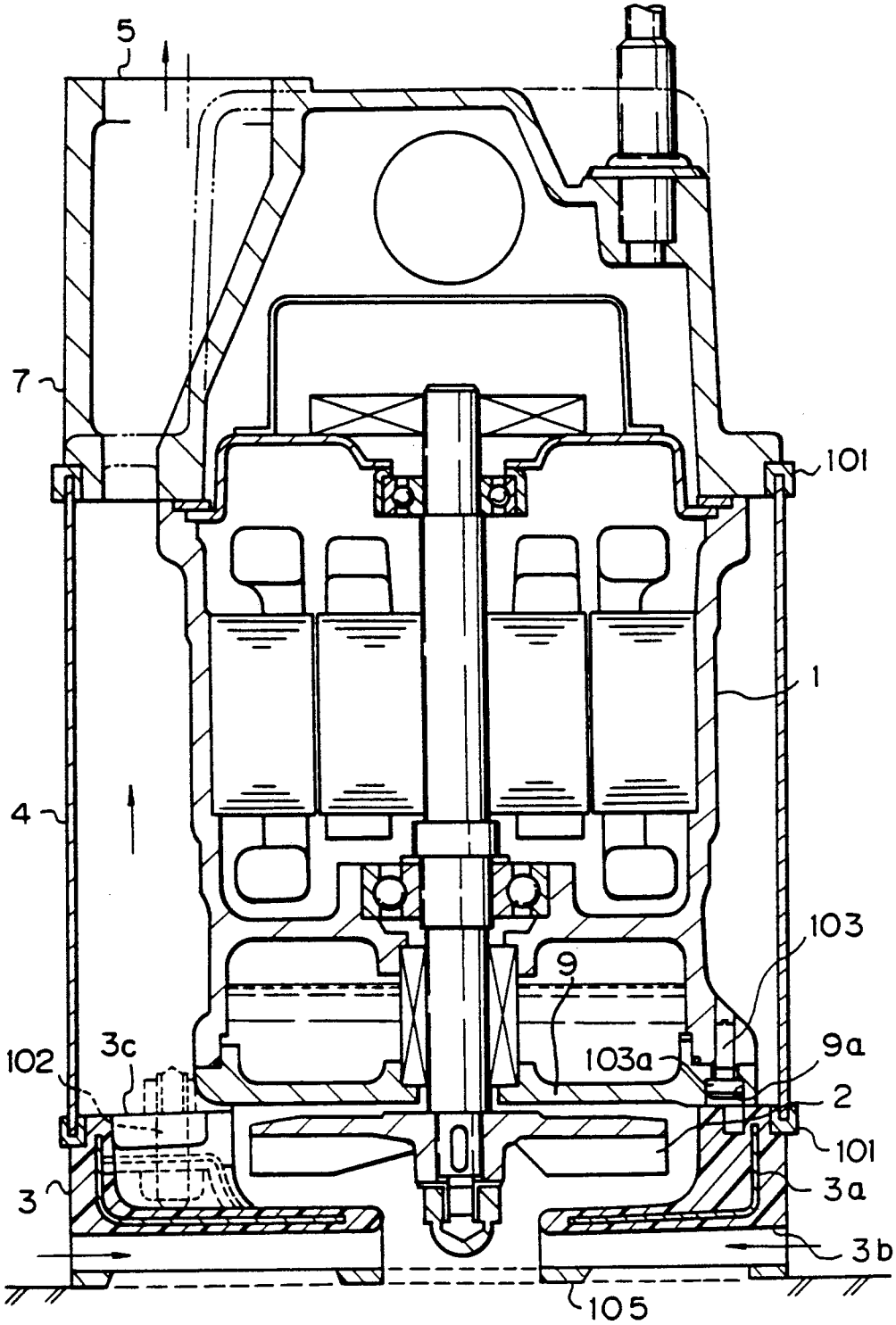
Fig. 2 PRIOR ART
Figure 3A:
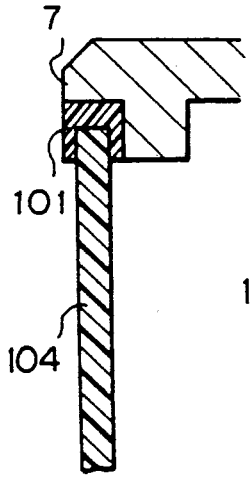
FIG.3a PRIOR ART
FIGS. 3(*a*) to 3(*d*) are fragmentary sectional views of an essential part of a prior art, which show a problem of the prior art.
Figure 3B:
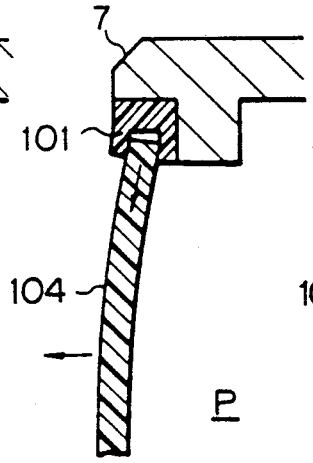
FIG.3b PRIOR ART
Figure 3C:
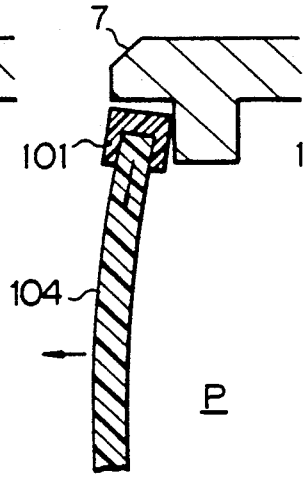
FIG.3c PRIOR ART
Figure 3D:
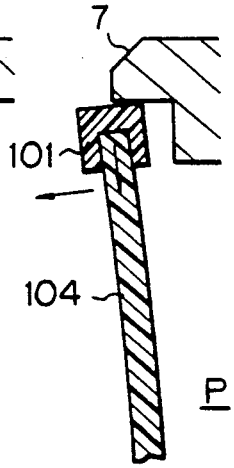
FIG.3d PRIOR ART
Figure 4A:
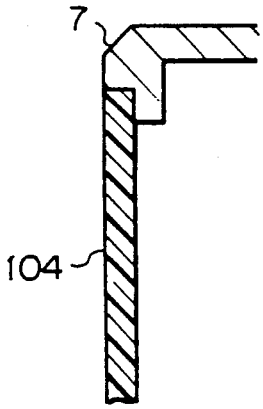
FIG.4a PRIOR ART
FIGS. 4(*a*) and 4(*b*) are fragmentary sectional views of an essential part of another prior art, which show a problem of the prior art.
Figure 4B:
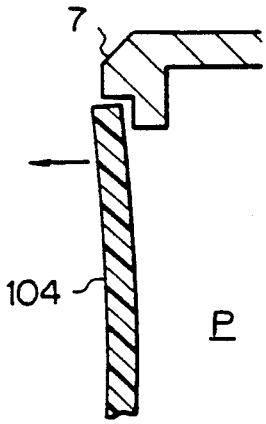
FIG.4b PRIOR ART
Figure 5A:
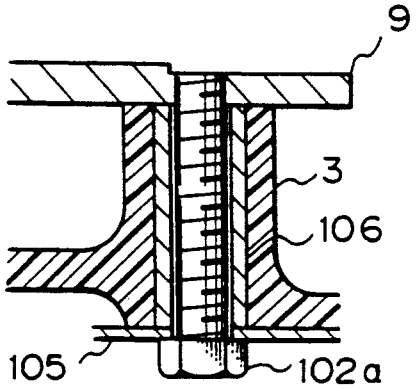
FIG.5a PRIOR ART
FIGS. 5(*a*) to 5(*c*) are fragmentary sectional views respectively showing essential parts of three different types of prior art.
Figure 5B:
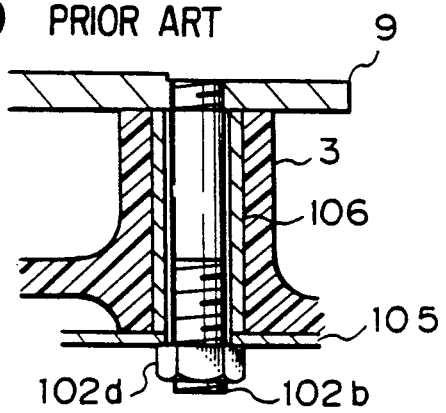
FIG.5b PRIOR ART
Figure 5C:
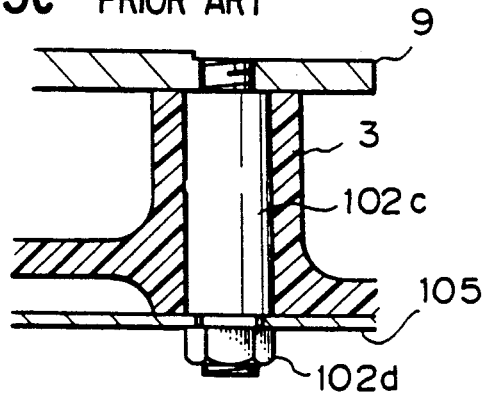
FIG.5c PRIOR ART

Further, a plurality of reinforcing ribs 17 serving in combination as a strainer are provided integral with the underside of the pump casing portion 11*a* such that the ribs 17 are spaced apart from each other along the entrance of the fluid passage 14 extending around the entire periphery of the motor pump. A ring-shaped strainer 26 which is made of a resilient material such as a rubber material is resiliently fitted onto the outer surfaces of the circularly disposed reinforcing ribs 17 from the lower side of a ring-shaped member 15*a* formed integral with the bottom plate 15. It should be noted that the strainer 26 is a flat resilient ring-shaped member with a large number of openings and the circumference of the strainer 26 when in a free state is substantially the same as in the case where it is fitted on the reinforcing ribs 17. In FIG. 2, the reference numeral 20 denotes an annular passage defined between the outer casing portion 11*b* and the outer surface of the motor 1, 21 a pump casing suction port, and 22 a casing discharge port.

Figure 8A:
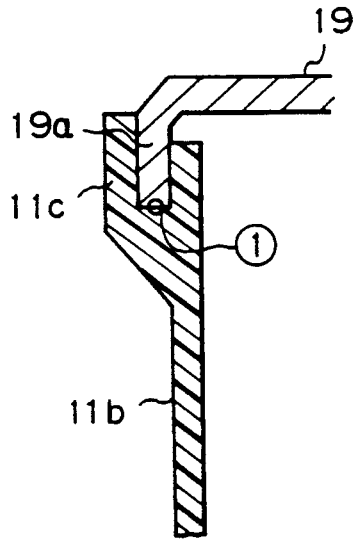
FIGS. 8(*a*) and 8(*b*) show the function of an essential part of the second embodiment of the present invention.
Figure 8B:
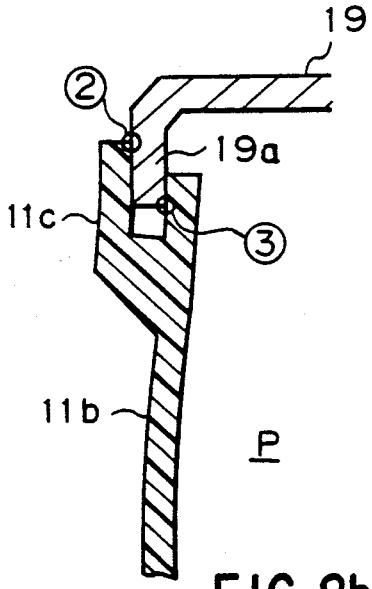

In the operation of the motor pump according to this embodiment, a fluid flows into the inside of the pump casing portion 11*a*, that is, the pump chamber, through the pump casing suction port 21 from the passage 14 defined between the underside of the pump casing portion 11*a* and the bottom plate 15, as shown by the arrow a. The sucked fluid is pressurized by the operation of the impeller 13, discharged from the casing discharge port 22 to flow through the annular passage 20 defined between the outer periphery of the motor 1 and the outer casing portion 11*b* while cooling the outer casing of the motor and then discharged to the outside from the pump discharge port 18. When the pump is at rest, the outer casing portion 11*b* assumes the position shown in FIG. 8(*a*) (where sealing is effected at the point ① by means of the axial fastening force), whereas, when subjected to internal pressure P which is applied by the pressurized fluid, the outer casing portion 11*b* is deformed outwardly, as shown in FIG. 3(*b*). At this time, however, the annular groove provided in the upper end 11*c* of the outer casing portion 11*b* and the annular projection at the lower end of the motor head cover (rigid member) 19 are in close contact with each other at two points ② and ③. Therefore, the required sealing performance is ensured.

Figure 9A:
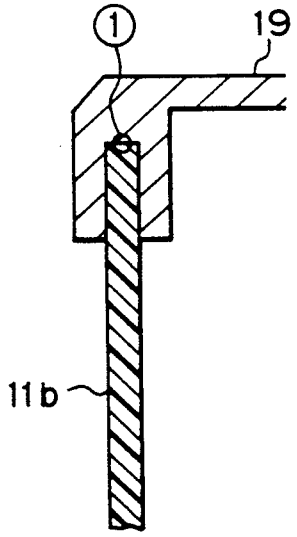
FIGS. 9(*a*) and 9(*b*) show the function of an essential part of another embodiment of the present invention.
Figure 9B:
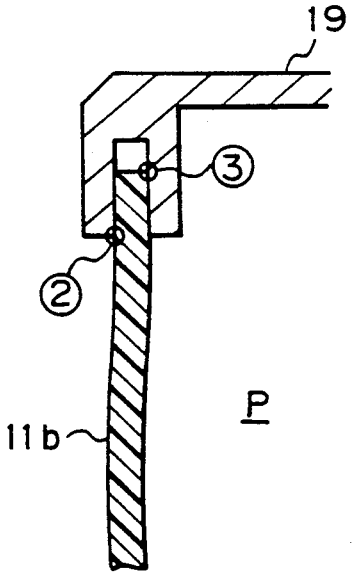

It should be noted that the engagement between the outer casing portion 11*b* and the lower end portion 19*a* of the motor head cover 19 may be effected through engagement between an annular projection which is formed on the outer casing portion 11*b* and an annular groove formed in the lower end of the motor head cover 19, as shown in FIG. 9(*a*) and 9(*b*). In this case also, the same sealing performance is obtained.

Further, since the downwardly tapered leg portions 12*a* are provided integral with the underside of the intermediate casing 12, it is easy to effect alignment when the pump casing portion 11*a* is fastened between the intermediate casing 12 and the bottom plate (pump plate) 15 by means of the bolts 16 which are brought into threaded engagement with the internally threaded bores in the leg portions 12*a* and it is also possible to reduce the number of parts required.

Since the head 25*a* of each bolt 25 used to fasten the intermediate casing 12 to the underside of the motor 1 is received in the recess 11*d* formed in the resilient outer casing portion 11*b* which is in contact with the intermediate casing 12, it is not only possible to reduce the thickness of the intermediate casing 12 but also to facilitate the operation of turning and driving the bolt 25.

Although in the foregoing embodiments, the upper and lower end portions of the resilient member 11 that constitute the pump casing portion 11*a* and the outer casing portion 11*b* are retained by the motor head cover 19 and the bottom plate 15, respectively, the present invention is of course not necessarily limited to the described structure. The cross-sectional configuration and pitch of the projections 17 serving as a strainer which are formed integral with the underside of the pump casing 11*a* may also be variously modified according to use conditions or the like. In addition, the resilient material used in the present invention is not necessarily limited to a rubber material.

The submerged motor pump having the foregoing arrangement provides the following advantages:

(i) Since the outer casing is formed using a resilient material and is retained at both its upper and lower ends by rigid members, it is deformable in the radial direction so as to absorb external force, for example, impact force, which may be applied thereto during transportation. Accordingly, the outer casing is not readily affected by external force and handling thereof is hence facilitated.

(ii) Since the pump casing and the outer casing are formed integral with each other using a resilient material, the number of parts is reduced and hence the structure is considerably simplified, so that assembly and disassembly are facilitated.

(iii) Since most of the portions which are most likely to be subjected to external force are formed of a resilient material, it becomes possible to use a thin-walled light material, e.g., a plastic material, to form internal structural parts, and this enables a reduction in the overall weight in combination with the fact that the bulking density of the resilient material is lower than that of a metallic material.

(iv) Since the pump casing and outer casing portions along which a liquid passes during pumping operation are formed using a resilient material, the resistance to wear with respect to sand and the like found in drains is improved.

(v) Since the pump casing portion and the outer casing portion are formed integral with each other using a resilient material, it is possible to simplify the sealing structure at the joint between members subjected to pressure and each of these portions.

(vi) Since it is possible to form a strainer integral with the underside of the pump casing formed of a resilient material, productivity is further improved.

(vii) Since the upper end portion of the resilient outer casing is provided with either an annular projection or an annular groove, while the lower end portion of a rigid member which retains the upper end portion of the outer casing is provided with the other of the two, the required sealing performance is maintained even if the resilient outer casing is deformed due to internal or external pressure.

(viii) When leg portions which extend through the pump casing portion are provided integral with the underside of the intermediate casing, the number of parts required to fasten together the three, that is, the intermediate casing, the pump casing (outer casing) and the pump bottom plate may be reduced and the alignment conducted during assembly facilitated.

(ix) When the head of each bolt used to fasten the intermediate casing to the underside of the motor is received in a recess formed in the resilient outer casing which is in contact with the underside of the intermediate casing, it is possible not only possible to reduce the thickness of the intermediate casing but also to facilitate the operation of turning and driving the bolt.

Although the present invention has been described through specific terms, it should be noted here that the described embodiments are not necessarily exclusive and various changes and modifications may be imparted thereto without departing from the scope of the invention which is limited solely by the appended claims.

What is claimed is:

1. A submerged motor pump of the type in which a motor is installed inside an outer casing so as to define an annular passage therebetween and a pumped liquid is discharged to the outside through the annular passage while cooling the entire periphery of the motor, wherein;

said outer casing is formed integral with a pump casing using a rubber material, and said integral structure is retained only at its axial upper and lower ends by rigid members which are located outside of said annular passage for allowing said outer casing to be deformable in the radial direction.

2. A submerged motor pump according to claim 1, wherein a strainer is formed integral with the underside of said pump casing.

3. A submerged motor pump according to claim 1, wherein the upper end portion of said outer casing is provided with an annular projection, while the lower end portion of a rigid member which retains the upper end portion of said outer casing is provided with an annular groove.

4. A submerged motor pump according to claim 1, wherein the upper side of said pump casing is covered with an intermediate casing formed of a rigid material, said intermediate casing having leg portions provided integral with the underside thereof, said leg portions extending through said pump casing, so that said pump casing is clamped between said intermediate casing and a pump plate which is attached to the underside of said pump casing by means of bolts each of which is brought into threaded engagement with a threaded portion formed in said leg portion.

5. A submerged motor pump according to claim 1 or 4, wherein the upper side of said pump casing is covered with an intermediate casing formed of a rigid material, said intermediate casing being fastened to the underside of said motor by means of bolts each head of which is received in a recess formed in said resilient outer casing which is in contact with the underside of said intermediate casing.

6. A submerged motor pump according to claim 1, wherein the upper end portion of said outer casing is provided with an annular groove, while the lower end portion of a rigid member which retains the upper end portion of said outer casing is provided with an annular projection.

* * * * *